United States Patent [19]

Yonese et al.

[11] Patent Number: 4,828,957

[45] Date of Patent: May 9, 1989

[54] TWO-COLOR HEAT-SENSITIVE RECORDING MATERIAL WITH 2-HYDROXY-3-NAPHTHOANILIDE AS BOTH COUPLER AND COLOR DEVELOPING AGENT

[75] Inventors: Naoki Yonese, Nishinomiya; Tosaku Okamoto, Osaka; Mitsuru Kondo, Hyogo, all of Japan

[73] Assignee: Kanzaki Paper Manufacturing Company, Ltd., Tokyo, Japan

[21] Appl. No.: 53,724

[22] Filed: May 26, 1987

[30] Foreign Application Priority Data

May 31, 1986 [JP] Japan ..... 61-126018

[51] Int. Cl.[4] ..... G03C 1/58; G03C 1/60; B41M 5/18

[52] U.S. Cl. ..... 430/138; 430/151; 430/158; 430/162; 430/177; 430/179; 430/180; 503/204; 503/214

[58] Field of Search ..... 430/138, 151, 177, 179, 430/180, 158, 162; 503/204, 214

[56] References Cited

U.S. PATENT DOCUMENTS

| | | | |
|---|---|---|---|
| 3,900,215 | 8/1975 | Kato et al. | 503/210 |
| 3,934,070 | 1/1976 | Kimura et al. | 503/210 |
| 4,613,878 | 9/1986 | Inaba et al. | 346/204 |
| 4,620,204 | 10/1986 | Inaba et al. | 346/204 |
| 4,620,205 | 10/1986 | Iiyama et al. | 346/204 |
| 4,636,819 | 1/1987 | Nagamoto et al. | 503/200 |
| 4,644,376 | 2/1987 | Usami et al. | 430/179 |

FOREIGN PATENT DOCUMENTS

| | | | |
|---|---|---|---|
| 147790 | 9/1982 | Japan | 346/204 |

*Primary Examiner*—Charles L. Bowers, Jr.
*Attorney, Agent, or Firm*—Larson and Taylor

[57] ABSTRACT

Disclosed is a two-color heat-sensitive recording material which comprises a base sheet and a recording layer of single-layer or multi-layer structure formed on the base sheet, the recording layer comrising:

(a) a diazonium salt, (b) a basic leuco dye, (c) a 2-hydroxy-3-naphthoic acid derivative which acts as a coupler compound for causing the diazonium salt to develop color when heated and which also acts as a color developing material for causing the basic leuco dye to develop color when heated, and (d) a basic substance, wherein the diazonium salt and the basic leuco dye each form a color upon application of heat, thereby giving the first image of a mixed color, and, then, after irradiation of an active ray to decompose the diazonium salt, the basic leuco dye alone forms its own color upon application of heat, thereby giving the second image whose color is different from the mixed color of the first image.

6 Claims, No Drawings

TWO-COLOR HEAT-SENSITIVE RECORDING MATERIAL WITH 2-HYDROXY-3-NAPHTHOANILIDE AS BOTH COUPLER AND COLOR DEVELOPING AGENT

The present invention relates to a heat-sensitive recording material, and more particularly to a novel two-color heat-sensitive recording material.

Heat-sensitive recording materials are already well-known which utilize the color forming reaction between a chromogenic material and a color developing material adapted to develop a color upon contact therewith, such that the two materials are brought into contact with each other by application of heat to obtain record images. These heat-sensitive recording materials are relatively inexpensive and are usable with a recording device which is compact and easy to maintain so that they are used as recording media for facsimile systems, computers, etc. and have found wide application.

For application to wider use, however, such recording materials must fulfill a wider variety of requirements as to performance and quality, such as higher sensitivity, higher stability of images and multicolor recording. Especially because multicolor recording is useful for a wide range of applications, various multicolor recording materials have heretofore been investigated and proposed.

The conventional two-color heat-sensitive recording materials are generally divided into the following two types. Those of the first type are adapted to produce a color with a low-temperature color-forming layer when heated to a low temperature, and to cause each of this layer and a high-temperature color-forming layer to produce a color to give a mixed color when heated to a high temperature. Alternatively, the high-temperature color-forming layer alone is adapted to produce its color when the material is heated to the high temperature, with a decolorizing agent acting to eliminate the color of the low-temperature color-forming layer. U.S. Pat. Nos. 4,613,878, 4,620,204 and 4,620,205 disclose recording materials of this type.

With the recording materials of the first type, there is a need to produce a difference in thermal responsiveness by suitably selecting the compounds which effect the colot forming reactions. The compounds usable are therefore limited, and this consequently imposes great limitations on the design and production conditions of the recording material. Further because the recording material is adapted to produce record images of different colors by virtue of a difference in temperature, the low-temperature color-forming layer around the image formed at the high temperature produces its color owing to heat transfer, invariably fringing the high-temperature image with the low-temperature color, hence a serious objection to the use of the material. This drawback will be hereinafter be referred to as "fringing."

Recording materials of the second type comprise a recording layer which is obtained by coating a base sheet with a diazonium salt, coupler therefor, basic leuco dye and a color developing material for the dye, in the form of a single layer or double layer, as disclosed in Unexamined Japanese Patent Publication No.57-138978 or No.58-55287. When the recording layer is heated for recording, the diazonium salt and the leuco dye produce their own colors, thereby giving a first image of mixed color, and the recording layer is thereafter irradiated with light to decompose the diazonium salt, followed by application of heat, thereby permitting the leuco dye alone to form a second record image with its color. The color developing materials for the leuco dyes are acid substances such as bisphenol A, p-hydroxybenzoic acid esters and the like. However, such acid substances seriously hamper the reaction between the diazonium salt and the coupler, consequently diminishing the color difference between the first and second record images to greatly impair the commercial value of the recording material.

An object of the present invention is to provide improvements in two-color heat-sensitive recording materials of the second type to overcome the foregoing drawbacks and to provide a new two-color heat-sensitive recording material which is capable of producing different colors even with use of a thermal head or thermal pen substantially at the same temperature.

The present invention provides a two-color heat-sensitive recording material which comprises a base sheet and a recording layer of single-layer or multi-layer structure formed on the base sheet, the recording layer comprising:

(a) a diazonium salt, (b) a basic leuco dye, (c) a 2-hydroxy-3-naphthoic acid derivative which acts as a coupler compound for causing the diazonium salt to develop color when heated and which also acts as a color developing material for causing the basic leuco dye to develop color when heated, and (d) a basic substance.

We have conducted extensive research on various materials and consequently found that 2-hydroxy-3-naphthoic acid derivatives which are useful as couplers for diazonium salts also function as color developing materials for leuco dyes and that the use of the derivative provides a two-color heat-sensitive recording material which is free of the foregoing drawbacks. Thus, the present invention has been accomplished.

The two-color heat-sensitive recording material of the invention contains none of acid substances, such as bisphenol A, serviceable as color developers for leuco dyes but incorporates a 2-hydroxy-3-naphthoic acid derivative which is conventionally used as a coupler compound for diazonium salts and further contains a basic substance, consequently permitting the diazonium salt present to readily react with the coupler compound (i.e., the 2-hydroxy-3-naphthoic acid derivative) and also causing the leuco dye to develop its color easily by the action of said coupler compound. Thus, the coupler compound acts to cause both the diazonium salt and the leuco dye to develop their colors when heated and to readily form a first record image with the mixture of these colors. In order to decompose the diazonium salt, the recording layer is thereafter irradiated with active rays, and then a second record image is formed by the leuco dye alone upon application of heat in an area other than the first image area, with a distinct color difference from the first image due to the absence of color originating from the diazonium salt.

The diazonium salt to be used in the present invention can be any of a wide variety of those heretofore used for diazo heat-sensitive recording materials. Examples of useful diazonium salts are tetraphenylborate, tetrafluoroborate, hexafluorophosphate, double salts of zinc chloride and chlorides, of diazonium compounds such as 4-dimethylaminobenzenediazonium, 4-morpholino-2,5-dibutoxybenzenediazonium, 4-(4-methoxy)-benzylamino-2,5-diethoxybenzenediazonium, 4-morpholinobenzenediazonium, 4-pyrrolidino-3-methylbenzenediazonium, 4-(N-ethyl-N-hydroxyethyl-)anilinediazonium, 4-benzamido-2,5-diethoxybenzenediazonium, 4-diethylamino-3-methylbenzenediazonium, 4-morpholino-3-methylbenzenediazonium, 4-morpholino-2,5-diisopropoxybenzenediazonium, 4-morpholino-2,5-diethoxybenzenediazonium, 4-diethylaminobenzenediazonium, 4-dipropylaminobenzenediazonium, 4-methylbenzylaminobenzediazonium, 4-dibenzylaminobenzenediazonium, 4-diethylamino-2-methoxybenzenediazonium, 4-dimethylamino-3-methylbenzenediazonium, 4-morpholino-2,5-diethoxybenzenediazonium, 4-anilinobenzenediazonium, 4-dimethylamino-2-carboxybenzenediazonium and 4-toluylmercapto-2,5-diethoxybenzenediazonium; etc. Useful diazonium salts are not limited to those exemplified above.

The basic leuco dyes which can be used in the invention include a wide range of those conventionally used in heat-sensitive recording materials. Examples of useful leuco dyes are 3-diethylamino-6-methylfluoran, 3-diethylamino-7-methylfluoran, 3-diethylamino-7-chlorofluoran, 3-diethylamino-6,8-dimethylfluoran, 3-diethylamino-7-phenylfluoran, 3-diethylamino-5-methyl-7-tertbutfluoran, 3-diethylamino-6-methyl-7-chlorofluoran, 3-diethylamino-7-methoxyfluoran, 3-cyclohexylamino-7-methylfluoran, 3-cyclohexylamino-6-chlorofluoran, 3-benzylamino-6-chlorofluoran, 3-diethylamino-7-chlorofluoran, 3-diethylamino-7,8-benzofluoran, 3-diethylamino-6-methoxyfluoran, 3-diethylamino-7-(N-methyl-N-acetyl)aminofluoran, 4-benzylamino-8-diethylamino-benzo[a]fluoran, 3-anilino-8-diethylamino-benzo[a]fluoran, 3,6-bis(diethylamino)-fluoran-γ-anilinolactam, 3,6-bis(diethylamino)fluoran-γ-o-chloroanilinolactam, 3-diethylamino-7-dibenzylaminofluoran, 3-diethylamino-7-octylaminofluoran, 3-diethylamino-5-methyl-7-dibenzylaminofluoran, 3-(N-ethyl-N-p-tolyl)amino-7-(N-methyl-N-phenyl-)aminofluoran, 3,3-bis(1-ethyl-2-methylindole-3-yl)phthalide, 3,3-bis(1-octyl-2-methylindole-3-yl)phthalide, 3,3-bis(1-ethyl-2-methylindole-3-yl)-7-azaphthalide, etc. Useful basic leuco dyes are not limited to those exemplified above. These dyes can be used singly or at least two of them are usable in admixture.

The leuco dye to be used must be one which differs from the diazonium salt in the color to be formed by the coupler compound acting thereon. Since red is usually preferred as the color of the second record image, it is desirable to select a leuco dye which produces a red-type color.

Examples of coupler compounds to be used in the invention are phenyl 2-hydroxy-3-naphthoate, 4'-methoxyphenyl 2-hydroxy-3-naphthoate, 3'-nitrophenyl 2-hydroxy-3-naphthoate, 4'-chlorophenyl 2-hydroxy-3-naphthoate, 2'methylphenyl 2-hydroxy-3-naphthoate, 2'-ethoxyphenyl 2-hydroxy-3-naphthoate, 2'-methoxyphenyl 2-hydroxy-3-naphthoate, 2'-methyl-4'-chlorophenyl 2-hydroxy-3-naphthoate, 2'-methoxy-5'-nitrophenyl 2-hydroxy-3-naphthate, 2'-methyl-5'-chlorophenyl 2-hydroxy-3-naphthate, 2'-methoxy-5'-chlorophenyl 2-hydroxy-3-naphthoate, 3',6'-dimethoxy-4'-chlorophenyl 2-hydroxy-3-naphthoate, 3'-chloro-4',6'-dimethoxypenyl 2-hydroxy-3-naphthoate, N-(3-morpholinopropyl)-2-hydroxy-3-naphthamide, N-(4-diethylaminobutyl)-2-hydroxy-3-naphthamide, N-(2-piperidinoethyl)-2-hydroxy-3-naphthamide, N-benzyl-2-hydroxy-3-naphthamide, N-(o-ethoxybenzyl)-2-hydroxy-3-naphthamide, N-(p-chlorobenzyl)-2-hydroxy-3-naphthamide, N-(p-methylbenzyl)-2-hydroxy-3naphthamide, and 2-hydroxy-3-naphthanilide derivatives of the formula

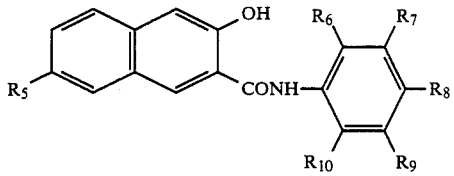

(I)

wherein $R_5$ is hydrogen atom; halogen atom; $C_1$–$C_4$ alkyl or $C_1$–$C_4$ alkoxy; $R_6$, $R_7$, $R_8$, $R_9$ and $R_{10}$ are each hydrogen atom; halogen atom; $C_1$–$C_4$ alkyl; $C_1$–$C_4$ alkoxy; phenoxy optionally substituted with halogen atom, $C_1$–$C_4$ alkyl or $C_1$–$C_4$ alkoxy; benzyl optionally substituted with halogen atom, $C_1$–$C_4$ alkyl or $C_1$–$C_4$ alkoxy; benzyloxy optionally substituted with halogen atom, $C_1$–$C_4$ alkyl or $C_1$–$C_4$ alkoxy; or $C_5$–$C_{12}$ cycloalkyl; and $R_6$ and $R_7$, or $R_7$ and $R_8$, when taken together with the two carbon atoms to which they are attached, may form a benzene ring.

The foregoing coupler compounds can be used singly or at least two of them are usable in admixture.

Of the above coupler compounds, the compounds represented by the formula (I) are preferred since they have especially excellent ability to cause the leuco dyes to form color.

Typical examples of the compounds represented by the formula (I) are 2-hydroxy-3-naphthanilide, 2-hydroxy-6-ethoxy-3-naphthanilide, 2-hydroxy-3-naphtho-2'-methylanilide, 2-hydroxy-6-chloro-3-naphtho-2'-methylanilide, 2- hydroxy-3-naphtho-2',4',6'-trimethylanilide, 2-hydroxy-3-naphtho-4'-chloroanilide, 2-hydroxy-3-naphtho-2',6'-dichloroanilide, 2-hydroxy-3-naphtho-2',4',6'-trichloroanilide, 2-hydroxy-3-naphtho-4'-methoxyanilide, 2-hydroxy-3-naphtho-2'-methyl-3'-methoxyanilide, 2-hydroxy-3-naphtho-2'-methyl-4'-methoxyanilide, 2-hydroxy-6-ethyl-3-naphtho-2'-methyl-4'-ethoxyanilide, 2-hydroxy-3-naphtho-2'-methyl-5'-methoxyanilide, 2-hydroxy-3-naphtho-3',4'dimethylanilide, 2-hydroxy-3-naphtho-3',4',5'-trimethoxyanilide, 2-hydroxy-3-naphtho-4'-ethoxyanilide, 2-hydroxy-3-naphtho-3',4'-diethoxyanilide, 2-hydroxy-3-naphtho-4'-phenoxyanilide, 2-hydroxy-3-naphtho-2'-phenoxyanilide, 2-hydroxy-3-naphtho-4'-(o-tert-butylphenoxy)anilide, 2-hydroxy-3-naphtho-4'-(o-chlorophenoxy)anilide, 2-hydroxy-3-naphthro-4'-(o-ethoxyphenoxy)anilide, 2-hydroxy-3-naphtho-2'-phenoxy-5',6'-benzoanilide, 2-hydroxy-3-naphtho-4'-benzyloxyanilide,2-hydroxy-4'-(p-chlorobenzyloxy)anilide, 2-hydroxy-3-naphtho-4'-(p-methylbenzyloxy)anilide, 2-hydroxy-3-naphtho-4'-(o-ethoxybenzyloxy)anilide, 2-hydroxy-3-naphtho-2'-benzyloxyanilide, 2-hydroxy-3-naphtho-2',3'-benzoanilide, 2-hydroxy-3-naphtho-3',4'-benzoanilide, 2-hydroxy-3-naphtho-4'-cyclohexylanilide, 2-hydroxy-3-naphtho-4'-cyclododecylanilide, 2-hydroxy-3-naphtho-4'-benzylanilide,etc.

The basic substance effects the color forming reaction between the diazonium salt and the coupler compound when heated. Examples of the basic substances to be used in the invention are organic amines such as tricyclohexylamine and tribenzylamine, imidazoles such as benzimidazole, 2-benzylimidazole and 2-phenyl- 4-methylimidazole, imidazolines such as 2-undecylimidazoline, 2,4,5-triphenyl-2-imidazoline, 1,2-diphenyl-4,4-dimethyl-2-imidazoline, and 2-phenyl-2-imidazoline, thiazoles such as 2-amino-benzothiazole and 2-benzoylhydrazino-benzothiazole, piperazines such as N,N'-dibenzylpiperazine, amidines such as N,N'-diphenylformamidine and N,N',N'',N'''-tetraphenyl-p-xylenediamidine, morpholines such as 4,4'-dithiomorpholine, and nitrogen-containing compounds such as pyrroles, pyrimidines, triazoles, piperidines and guanidines.

Among these basic substances, guanidines, preferably those represented by the formula (II) or (III) below, more preferably those represented y the formula (II), are desirable since they are very unlikely to inhibit the color forming reaction between the leuco dye and the 2-hydroxy-3-naphthoic acid derivative and since they promote the reaction between the diazonium salt and the naphthoic acid derivative.

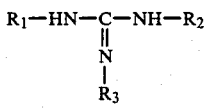

(II)

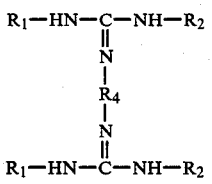

(III)

wherein $R_1$, $R_2$ and $R_3$ are each hydrogen atom; $C_1$–$C_{18}$ alkyl; $C_5$–$C_{12}$ cycloalkyl; phenyl optionally substituted with halogen atom, nitro, $C_1$–$C_4$ alkyl, $C_1$–$C_4$ haloalkyl, $C_1$–$C_4$ alkoxy, $C_1$–$C_8$ alkylamino or $C_1$–$C_4$ acylamino; benzyl optionally substituted with a halogen atom, nitro, $C_1$–$C_4$ alkyl, $C_1$–$C_4$ haloalkyl, $C_1$–$C_4$ alkoxy, $C_1$–$C_8$ alkylamino or $C_1$–$C_4$ acylamino; $C_1$–$C_8$ alkylamino; $C_1$–$C_4$ acylamino; benzoylamino optionally substituted with halogen atom, nitro, $C_1$–$C_4$ alkyl or $C_1$–$C_4$ alkoxy; or phenylcarbamoylamino optionally substituted with halogen atom, nitro, $C_1$–$C_4$ alkyl or $C_1$–$C_4$ alkoxy; and $R_4$ is $C_1$–$C_4$ alkylene; phenylene; naphthylene or

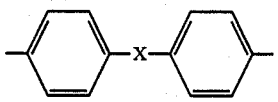

wherein X is $C_1$–$C_4$ alkylene, —$SO_2$—, —S—S—, —S—, —O—, —NH— or a single bond.

Examples of guanidine derivatives represented by the formula (II) or (III) are 1,2,3-triphenylguanidine, 1,3-diphenylguanidine, 1,3-diphenyl-2-m-chlorophenylguanidine, 1,3-diphenyl-2-p-chlorophenylguanidine, 1,3-diphenyl-2-m-trifluoromethylphenylguanidine, 1,3-di-m-chlorophenylguanidine, 1,3-di-m-chlorophenyl-2-phenylguanidine, 1,3-di-m-trifluoromethylphenyl-2-phenylguanidine, 1,3-di-p-methoxyphenyl-2-phenylguanidine, 1,3-di-p-methylphenyl-2-phenylguanidine, 1,3-diphenyl-2-p-methylphenylguanidine, 1,3-diphenyl-2-o-methylphenylguanidine, 1,3-di-p-methylphenyl-2-cyclohexylguanidine, 1,3-di-p-methoxyphenyl-2-cyclohexylguanidine, 1,3-diphenyl-2-cyclohexylguanidine, 1,3-dicyclohexyl-2-o-methylphenylguanidine, 1,3-dicyclohexyl-2-o,p-dimethylphenylguanidine, 1,3-dicyclohexyl-2-p-methylphenylguanidine, 1,3-dicyclohexyl-2-o-chlorophenylguanidine, 1,3-dicyclohexyl-2-phenylguanidine, 1,2,3-tricyclohexylguanidine, 1,3-dicyclohexyl-2-p-dimethylaminophenylguanidine, 1,3-dicyclohexyl-2-p-acetaminophenylguanidine, 1,2-dicyclohexyl-3-benzoylaminoguanidine, 1,2-dicyclohexyl-3-(N-phenylcarbamoyl)aminoguanidine, 2,2'-{methylene-bis(p-phenylene)}-bis(1,3-diphenylguanidine), 2,2'-{methylene-bis(p-phenylene)]-bis(1,3-dicyclohexylguanidine), 2,2'-(p-phenylene)-bis(1,3-dicyclohexylguanidine), 2,2'-{thio-bis(p-phenylene)}-bis(1,3-dicyclohexylguanidine), 2,2'-{oxy-bis(p-phenylene)}-bis(1,3-dicyclohexylguanidine), 2,2'-{sulfo-bis(p-phenylene)}-bis(1,3-dicyclohexylguanidine), 2,2'-(p,p'-diphenylene)-bis(1,3-dicyclohexylguanidine), 2,2'-{imino-bis(phenylene)}-bis(1,3-dicyclohexylguanidine), etc. These compounds can be singly used or at least two of them are usable in admixture if required.

Heat-fusible materials may be used as a sensitizer for giving improved recording sensitivity to give high speed recording performance if necessary. Examples of the heat-fusible materials are caproic acid amide, capric acid amide, palmitic acid amide, stearic acid amide, oleic acid amide, erucic acid amide, linolic acid amide, linolenic acid amide, N-methylstearic acid amide, stearic acid anilide, N-methyloleic acid amide, benzanilide, linolic acid anilide, N-ethylcapric acid amide, N-butyllauric acid amide, N-octadecylacetamide, N-oleinacetamide, N-oleylbenzamide, N-stearylcyclohexylamide, polyethyleneglycol, 1-benzyloxynaphthalene, 1,2-diphenoxyethane, 1,4-diphenoxybutane, 1,2-di(3-methylphenoxy)ethane, 1-phenoxy-2-(4-chlorophenoxy)ethane, 1-phenoxy-2-(4-methoxyphenoxy)ethane, dibenzyl terephtalate, etc. Furthermore, various other known sensitizers for giving improved recording sensitivity may also be used.

The two-color heat-sensitive recording material of the invention is prepared usually by dispersing in water the diazonium salt, basic leuco dye, 2-hydroxy-3-naphthoic acid derivative, basic substance and, when desired, a sensitizer for giving improved recording sensitivity, etc. as finely divided to obtain a coating composition, and coating a substrate with the coating composition to form a recording layer thereon.

The proportions of diazonium salt and the leuco dye in the coating composition for forming the recording layer are variable in accordance with the colors to be obtained and are not limited specifically. Generally, however, it is suitable to use 0.1 to 5 parts by weight of the leuco dye per part by weight of the diazonium salt.

On the other hand, the coupler compound, i.e 2-hydroxy-3-naphthoic acid derivative, is used preferably in an amount of 0.5 to 10 parts by weight, more preferably 1 to 5 parts by weight, per part by weight of the diazonium salt.

It is desirable to adjust the amount of basic substance within the range of 0.2 to 10 parts by weight, more preferably of about 0.5 to about 5 parts by weight, per part by weight of the diazonium salt. A sensitizer for giving improved recording sensitivity, if used, is used preferably in an amount of 0.5 to 30 parts by weight, more preferably about 1 to about 10 parts by weight, per part by weight of the diazonium salt.

The coating composition may further incorporate therein known couplers for diazonium salts, such as acetoacetanilide, acetoaceto-p-toluidide and 4,4'-bis-(acetoaceto-o-toluidine), serving as color adjusting agents; preservatives such as sodium naphthalenesulfononate, sodium naphthalenedisulfononate, magnesium sulfate and zinc chloride; antioxidants such as thiourea, diphenylthiourea and urea; water-soluble or water-insoluble adhesives such as starch, casein, gum arabic, polyvinyl alcohol, polyvinyl acetate emulsion and SBR latex; pigments such as silica, clay, barium sulfate, titanium oxide and calcium carbonate; and auxiliary agents such as dispersant, ultraviolet absorber, defoaming agent, fluorescent dye, coloring dye, and the like.

As stated above, the heat-sensitive recording material of the invention is prepared generally by coating a substrate with a dispersion of diazonium salt, leuco dye, 2-hydroxy-3-naphthoic acid derivative, basic substance and, when desired, sensitizer, as finely divided. While the coating may be in the form of a single layer, individual dispersions of these components may be suitably mixed and then applied to the substrate in two or more superposed layers. It is also possible to prepare the recording material by impregnation or by incorporating the components into a paper substrate by the paper making process.

Further when required, the substrate can be coated with a dispersion of microcapsules prepared by dissolving at least one of the diazonium salt, leuco dye, 2-hydroxy-3-naphthoic acid derivative and basic substance, preferably the diazonium salt, in an organic solvent and encapsulating the solution as disclosed in Unexamined Japanese Patent Publication No. 60-6493.

The method of preparing the coating composition and the method of applying the composition are not limited specifically. The coating composition is applied generally in an amount of about 2 to about 12 g/m$^2$ by dry weight.

It is of course possible to form an overcoat over the recording layer for protecting the recording layer, or to provide an undercoat over the substrate. Thus, various techniques known in the art can be additionally employed in preparing the heat-sensitive recording material.

Examples of useful substrates are paper, plastic films, synthetic paper, etc., among which paper is preferable to use in view of cost, coatability, etc.

The heat-sensitive recording material of the invention is used for recording by forming a first record image with a thermal pen, thermal head or the like as usually done, then irradiating the entire recording layer with active rays (e.g., ultraviolet rays) of a fluorescent or mercury lamp or the like to decompose the unreacted diaonium salt and thereafter forming a second record image in the non-image area with the thermal pen or thermal head or the like in the usual manner.

The second record image thus formed differs from the first record image in color, with the result that the record obtained has two distinct colors.

The present invention will be described in greater detail with reference to the following examples, which are in no way limitative. The parts and percentages in these examples are all by weight unless otherwise specified.

EXAMPLE 1

(1) Preparation of dispersion A

| | |
|---|---|
| 4-Morpholino-2,5-diethoxybenzene-diazonium tetraphenylborate | 25 parts |
| 10% Aqueous solution of polyvinyl alcohol | 10 parts |
| Water | 65 parts |

The above composition was treated in a sand mill until the diazonium salt was pulverized to a mean particle size of 3 μm.

(2) Preparation of dispersion B

| | |
|---|---|
| 3-Diethylamino-6-chlorofluoran | 20 parts |
| 10% Aqueous solution of polyvinyl alcohol | 10 parts |
| Water | 70 parts |

The above composition was treated in a sand mill until the basic leuco dye was pulverized to a mean particle size of 3 μm.

(3) Preparation of dispersion C

| | |
|---|---|
| 2-Hydroxy-3-naphthanilide | 30 parts |
| 10% Aqueous solution of polyvinyl alcohol | 10 parts |
| Water | 60 parts |

The above composition was treated in a sand mill until the anilide was pulverized to a mean particle size of 3 μm.

(4) Preparation of dispersion D

| | |
|---|---|
| 1,2,3-Triphenylguanidine | 30 parts |
| 10% Aqueous solution of polyvinyl alcohol | 10 parts |
| Water | 40 parts |

The above composition was treated in a sand mill until the guanidine was pulverized to a mean particle size of 3 μm.

(5) Preparation of dispersion E

| | |
|---|---|
| 4,4'-Bis(acetoaceto-o-toluidine) | 30 parts |
| 10% Aqueous solution of polyvinyl alcohol | 10 parts |
| Water | 60 parts |

The above composition was treated in a sand mill until the toluidine was pulverized to a means particle size of 3 μm.

(6) Formation of recording layer

Fourteen parts of dispersion A, 34 parts of dispersion B, 22 parts of dispersion C, 28 parts of dispersion D, 11 parts of dispersion E, 10 parts of calcium carbonate, 15 parts of 10% aqueous solution of polyvinyl alcohol and 50 parts of water were mixed together by stirring to obtain a coating composition.

The composition was applied by a wire bar to wood-free paper, weighing 49 g/m$^2$, in an amount by dry weight of 7 g/m$^2$ and dried to obtain a heat-sensitive recording material.

(7) Two-color recording on recording material

A portion of the recording material was pressed by a heat plate at 120° C. under a pressure of 4 kg/cm$^2$ for 5 seconds to obtain a black first record image. The recording layer was then entirely irradiated with ultraviolet rays, and the remaining non-image area was pressed by the heat plate at 120° C. under a pressure of 4 kg/cm² for 5 seconds, whereby a red second record image was obtained. Each of the record image had a distinct color of its own free from fringing.

EXAMPLE 2

A heat-sensitive recording material was prepared in the same manner as in Example 1 except that dispersion E was not used. The recording material was treated in the same manner as in Example 1 to obtain a purplish black first record image. After irradiating the entire recording layer with ultraviolet rays, a red second record image was obtained in the same manner as in Example 1. The record images were distinct images, each free from fringing.

EXAMPLE 3

A heat-sensitive recording material was prepared in the same manner as in Example 1 except that the recording layer was formed by coating wood-free paper, weighing 49 g/m², with a first coating composition in an amount by dry weight of 3.5 g/m², drying the coating, applying a second coating composition to the dried coating in an amount by dry weight of 3.5 g/m² and drying the resulting coating. The first coating composition was prepared by mixing together 22 parts of dispersion C, 14 parts of dispersion D, 11 parts of dispersion E, 5 parts of calcium carbonate, 7.5 parts of 10% aqueous solution of polyvinyl alcohol and 50 parts of water with strirring. The second coating composition was prepared by mixing together 14 parts of dispersion A, 34 parts of dispersion B, 14 parts of dispersion D, 5 parts of calcium carbonate, 7.5 parts of 10% aqueous solution of polyvinyl alcohol and 50 parts of water with stirring. The recording material was treated in the same manner as in Example 1 to obtain a black first record image and a red second record image which were distinct and each free from fringing.

EXAMPLES 4–14

Eleven kinds of heat-sensitive recording materials were prepared in the same manner as in Example 3 except that the 2-hydroxy-3-naphthoic acid derivative listed in Table 1 was used in place of 2-hydroxy-3-naphthanilide for preparing dispersion C for each recording material. Table 1 also shows the colors of the first and second record images formed on each recording material in the same manner as in Example 3. The first and second record images formed on each recording material were distinct and each free from fringing.

TABLE 1

| Example | 2-Hydroxy-3-naphthoic acid derivative | Record image color First | Second |
|---|---|---|---|
| 4 | 2-Hydroxy-3-naphtho-2'-methylanilide | Black | Red |
| 5 | 2-Hydroxy-3-naphtho-2',4',6-trimethylanilide | Black | Red |
| 6 | 2-Hydroxy-3-naphtho-2',4',6-trichloroanilide | Black | Red |
| 7 | 2-Hydroxy-3-naphtho-4'-methoxyanilide | Black | Red |
| 8 | 2-Hydroxy-3-naphtho-4'-phenoxyanilide | Black | Red |
| 9 | 2-Hydroxy-3-naphtho-4'-(p-chlorobenzyloxy)-anilide | Black | Red |
| 10 | 2-Hydroxy-3-naphtho-2',3'-benzoanilide | Black | Red |
| 11 | 2-Hydroxy-3-naphtho-4'-cyclohexylanilide | Black | Red |
| 12 | 2-Hydroxy-3-naphtho-4'-benzylanilide | Black | Red |
| 13 | 2-Hydroxy-6-ethoxy-3-naphthanilide | Black | Red |
| 14 | Phenyl 2-hydroxy-3-naphthoate | Bluish black | Pale red |

EXAMPLES 15–17

Three kinds of heat-sensitive recording materials were prepared in the same manner as in Example 1 except that the diazonium salt listed in Table 2 was used in place of 4-morpholino-2,5-diethoxybenzenediazonium tetraphenylborate for preparing dispersion A for each recording material. Table 2 also shows the colors of the first and second record images formed on each recording material in the same manner as in Example 1. The first and second record images formed on each recording material were distinct and each free from fringing.

TABLE 2

| Example | Diazonium salt | Record image color First | Second |
|---|---|---|---|
| 15 | 4-Morpholino-2,5-isopropoxy-benzenediazonium tetraphenylborate | Black | Red |
| 16 | 4-(4-Methoxybenzoylamino)-2,5-diethoxybenzenediazonium tetraphenylborate | Black | Red |
| 17 | 4-Dimethylaminobenzene-diazonium chloride-zinc chloride double salt | Black | Red |

EXAMPLE 18

Four parts of 4-morpholino-2,5-dibutoxybenenediazonium hexafluorophosphate and 18 parts of an adduct of xylylene diisocyanate and trimethylolpropane (3:1) were dissolved in 12 parts of tricreasyl phosphate. This solution was added to a solution of 5.2 parts of polyvinyl alcohol in 58 parts of water and emulsified at 20° C. to obtain an emulsion having suspended therein particles having a mean size of 2.5 μm. Water (100 parts) was added to the emulsion, and the mixture was heated at 60° C. with stirring to effect reaction for 2 hours, giving a dispersion of microcapsules having the diazonium salt enclosed therein.

Subsequently, 10 parts of 3-cyclohexylamino-6-chlorofluoran, 15 parts of 2-hydroxy-3-naphtho-2',4',6'-trichloroanilide, 13 parts of 1,2,3-triphenylguanidine and 10 parts of butyl carbamate were added to 100 parts of 5% aqueous solution of polyvinyl alcohol, and the mixture was treated in a sand mill to obtain a dispersion of the leuco dye, coupler compound and basic substance, 3 μm in mean particle size.

The capsule dispersion of diazonium salt (50 parts) and 25 parts of the dispersion of leuco dye, coupler compound and basic substance were mixed together into a coating composition, which was then applied by a wire bar to wood-free paper, weighing 49 g/m², in an amount by dry weight of 6 g/m² and dried, giving a heat-sensitive recording material.

A portion of the recording material was pressed by a heat plate at 130° C. under a pressure of 4 kg/cm$^2$ for 5 seconds to obtain a purplish black first record image. The entire recording layer was then irradiated with ultraviolet rays, and the non-image area was thereafter pressed by the heat plate at 130° C. under a pressure of 4 kg/cm$^2$ for 5 seconds, whereby a yellowish red second record image was obtained. The record images were distinct and each free from fringing.

EXAMPLES 19–23

Five kinds of heat-sensitive recording materials were prepared in the same manner as in Example 18 except that the basic substance listed in Table 3 was used in place of 1,2,3-triphenylguanidine for each recording material. Table 3 also shows the colors of the first and second record images formed on each recording material in the same manner as in Example 18. Each image had a distinct color and free from fringing.

TABLE 3

| Example | Basic substance | Record image color First | Record image color Second |
|---|---|---|---|
| 19 | 1,3-Diphenylguanidine | Black | Red |
| 20 | 1,3-Di-m-chlorophenylguanidine | Black | Red |
| 21 | 1,3-Diphenyl-2-o-methylphenyl-guanidine | Black | Red |
| 22 | 1,3-Di-p-methylphenyl-2-cyclohexylguanidine | Black | Red |
| 23 | N,N'—Diphenylformamidine | Bluish black | Pale red |

The results of the foregoing examples reveal that the heat-sensitive recording materials of the invention produce first and second record images in two distinct colors each free from fringing.

We claim:

1. A two-color heat-sensitive recording material which comprises a base sheet and a recording layer of single-layer or multi-layer structure formed on the base sheet, the recording layer consisting essentially of:

(a) a diazonium salt;

(b) a basic leuco dye;

(c) a 2-hydroxy-3-naphthoanilide derivative represented by the formula

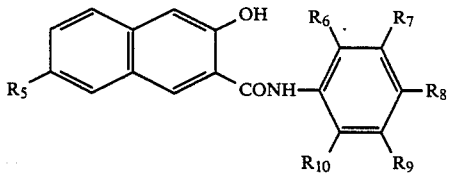

(I)

wherein $R_5$ is hydrogen atom; halogen atom; $C_1$–$C_4$ alkyl or $C_1$–$C_4$ alkoxy; $R_6$, $R_7$, $R_8$, $R_9$ and $R_{10}$ are each hydrogen atom; halogen atom; $C_1$–$C_4$ alkyl; $C_1$–$C_4$ alkoxy; phenoxy optionally substituted with halogen atom, $C_1$–$C_4$ alkyl or $C_1$–$C_4$ alkoxy; benzyl optionally substituted with halogen atom, $C_1$–$C_4$ alkyl or $C_1$–$C_4$ alkoxy; benzyloxy optionally substituted with halogen atom, $C_1$–$C_4$ alkyl or $C_1$–$C_4$ alkoxy; or $C_5$–$C_{12}$ cycloalkyl; and $R_6$ and $R_7$, or $R_7$ and $R_8$, when taken together with the two carbon atoms to which they are attached, may form a benzene ring which acts as a coupler compound for causing the diazonium salt to develop color when the recording layer is heated and which also acts as a color developing material for causing the basic leuco dye to develop color when the recording layer is heated, and (d) a basic substance; wherein the diazonium salt is decomposable by irradiation of an active ray, and the color formed by the reaction of the leuco dye and the 2-hydroxy-3-naphthoanilide derivative of the formula (I) differs from the color formed by the coupling of the diazonium salt and the 2-hydroxy-3-naphthoanilide derivative of the formula (I).

2. A recording material as defined in claim 1 wherein the basic substance is at least one guanidine derivative represented by the formula (II) or (III):

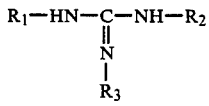

(II)

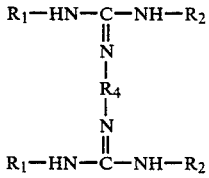

(III)

wherein $R_1$, $R_2$ and $R_3$ are each hydrogen atom; $C_1$–$C_{18}$ alkyl; $C_5$–$C_{12}$ cycloalkyl; phenyl optionally substituted with halogen atom, nitro, $C_1$–$C_4$ alkyl, $C_1$–$C_4$ haloalkyl, $C_1$–$C_4$ alkoxy, $C_1$–$C_8$ alkylamino or $C_1$–$C_4$ acylamino; benzyl optionally substituted with halogen atom, nitro, $C_1$–$C_4$ alkyl, $C_1$–$C_4$ haloalkyl, $C_1$–$C_4$ alkoxy, $C_1$–$C_8$ alkylamino or $C_1$–$C_4$ acylamino; $C_1$–$C_8$ alkylamino; $C_1$–$C_4$ acylamino; benzoylamino optionally substituted with halogen atom, nitro, $C_1$–$C_4$ alkyl or $C_1$–$C_4$ alkoxy; or phenylcarbamoylamino optionally substituted with halogen atom, nitro, $C_1$–$C_4$ alkyl or $C_1$–$C_4$ alkoxy; and $R_4$ is $C_1$–$C_4$ alkylene; phenylene; naphthylene or

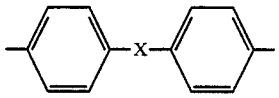

wherein X is $C_1$–$C_4$ alkylene, —$SO_2$—, —S—S—, —S—, —O—, —NH— or a single bond.

3. A recording material as defined in claim 1 wherein at last one of the diazonium salt, the basic leuco dye, the 2-hydroxy-3-naphthoanilide derivative and the basic substance is enclosed in microcapsules.

4. A two-color heat-sensitive recording material which comprises a base sheet and a recording layer of single-layer or multi-layer structure formed on the base sheet, the recording layer consisting essentially of:

(a) a diazonium salt, (b) a basic leuco dye, (c) a 2-hydroxy-3-naphthoanilide derivative represented by the formula

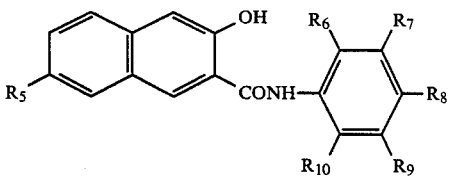

(I)

wherein $R_5$ is hydrogen atom; halogen atom; $C_1$–$C_4$ alkyl or $C_1$–$C_4$ alkoxy; $R_6$, $R_7$, $R_8$, $R_9$ and $R_{10}$ are each hydrogen atom; halogen atom; $C_1$–$C_4$ alkyl; $C_1$–$C_4$ alkoxy; phenoxy optionally substituted with halogen atom, $C_1$–$C_4$ alkyl or $C_1$–$C_4$ alkoxy; benzyl optionally substituted with halogen atom, $C_1$–$C_4$ alkyl or $C_1$–$C_4$ alkoxy; benzyloxy optionally substituted with halogen atom, $C_1$–$C_4$ alkyl or $C_1$–$C_4$ alkoxy; or $C_5$–$C_{12}$ cycloalkyl; and $R_6$ and $R_7$, or $R_7$ and $R_8$, when taken together with the two carbon atoms to which they are attached, may form a benzene ring which acts as a coupler compound for causing the diazonium salt to develop color when the recording layer is heated and which also acts as a color developing material for causing the basic leuco dye to develop color when the recording layer is heated, and (d) a basic substance; wherein the diazonium salt is decomposable by irradiation of an active ray, and the color formed by the reaction of the leuco dye and the 2-hydroxy-3-naphthoanilide derivative of the formula (I) differs from the color formed by the coupling of the diazonium salt and the 2-hydroxy-3-naphthoanilide derivative of the formula (I), and wherein the diazonium salt and the basic leuco dye form a color upon application of heat, thereby giving the first image of a mixed color, and, then, after irradiation of a active ray to decompose the diazonium salt, the basic leuco dye alone forms its own color upon application of heat, thereby giving the second image whose color is different from the mixed color of the first image.

5. A recording material as defined in claim 4 wherein the basic substance is at least one guanidine derivative represented by the formula (II) or (III):

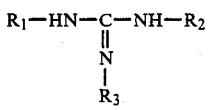

(II)

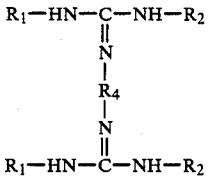

(III)

wherein $R_1$, $R_2$ and $R_3$ are each hydrogen atom; $C_1$–$C_{18}$ alkyl; $C_5$–$C_{12}$ cycloalkyl; phenyl optionally substituted with halogen atom, nitro, $C_1$–$C_4$ alkyl, $C_1$–$C_4$ haloalkyl, $C_1$–$C_4$ alkoxy, $C_1$–$C_8$ alkylamino or $C_1$–$C_4$ acylamino; benzyl optionally substituted with halogen atom, nitro, $C_1$–$C_4$ alkyl, $C_1$–$C_4$ haloalkyl, $C_1$–$C_4$ alkoxy, $C_1$–$C_8$ alkylamino or $C_1$–$C_4$ acylamino; $C_1$–$C_8$ alkylamino; $C_1$–$C_4$ acylamino; benzoylamino optionally substituted with halogen atom, nitro, $C_1$–$C_4$ alkyl or $C_1$–$C_4$ alkoxy; or phenylcarbamoylamino optionally substituted with halogen atom, nitro, $C_1$–$C_4$ alkyl or $C_1$–$C_4$ alkoxy; and $R_4$ is $C_1$–$C_4$ alkylene; phenylene; naphthylene or

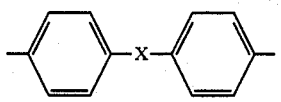

wherein X is $C_1$–$C_4$ alkylene, —$SO_2$—, —S—S—, —S—, —O—, —NH— or a single bond.

6. A recording material as defined in claim 4, wherein at least one of the diazonium salt, the basic leuco dye, the 2-hydroxy-3-naphthoanilide derivative and the basic substance is enclosed in microcapsules.

* * * * *